United States Patent [19]

Mattil

[11] 4,319,413

[45] Mar. 16, 1982

[54] SEAM CONSTRUCTION, PARTICULARLY FOR HEEL PORTIONS OF SHOES AND METHOD OF EFFECTING THE SAME

[75] Inventor: Klaus Mattil, Höheinöd, Fed. Rep. of Germany

[73] Assignee: Prüf-und Forschungsinstitut für die Schuhherstellung, Fed. Rep. of Germany

[21] Appl. No.: 139,345

[22] Filed: Apr. 11, 1980

[51] Int. Cl.[3] ..... A43B 23/00

[52] U.S. Cl. ..... 36/57; 12/146 C; 12/146 CK

[58] Field of Search ..... 36/57; 12/146 C, 146 CK

[56] References Cited

U.S. PATENT DOCUMENTS

| | | | |
|---|---|---|---|
| 341,864 | 5/1886 | Woodley | 36/57 |
| 1,040,781 | 10/1912 | Schwander | 36/57 |
| 1,429,604 | 9/1922 | Madinger | 36/57 UX |
| 2,316,363 | 4/1943 | Quinn et al. | 36/57 |
| 2,325,656 | 8/1943 | Brophy | 12/146 C |
| 4,120,101 | 10/1978 | Drew | 36/57 |

*Primary Examiner*—James Kee Chi

*Attorney, Agent, or Firm*—McGlew and Tuttle

[57] ABSTRACT

A seam interconnection to relatively thick material parts such as leather parts of shoes comprises parts which have edges which are aligned and have one surface such as the interiors or skin side surface of the leather which is formed with a groove extending along its height which is substantially parallel to and spaced inwardly from its associated edge. The two parts to be joined are aligned back to back with their outer or grain sides engaged and a threaded seam is made to hold the two parts together by placing the seam in the grooves of the respective parts. The parts are then formed to a desired shape, for example, are curved so as to form them into a heel and in so doing, the marginal area adjacent the edge is bent backwardly upon itself so that the overlying part extends into the groove. When a heel portion of a shoe is formed the curved configuration of each part is made so as to complement the configuration of the overlying parts resting in the groove so that an irregular surface is avoided.

6 Claims, 4 Drawing Figures

SEAM CONSTRUCTION, PARTICULARLY FOR HEEL PORTIONS OF SHOES AND METHOD OF EFFECTING THE SAME

FIELD AND BACKGROUND OF THE INVENTION

This invention relates in general particularly to the construction of shoes and in particular to a new and useful method and construction for seams of parts to be joined together in which the seams are made through grooves formed on interior surfaces of each of the parts and along which the two parts are stitched together and wherein marginal edges of the parts are bent over so that they engage into the grooves.

To manufacture the heel portion of shoes, the following operations have generally been performed:

Initially, the edge zones of the two leg parts are chamfered on the inside, i.e. as the flesh side of the leather, by evenly beveling the edge. Then, the leg parts placed on each other by their outsides are joined together by a thread seam parallel to the edges, with the seam extending in the area of the bevel remote from the edge proper of the leg part. After the sewing operation, the beveled edge portions projecting from the seam are rolled back over the seam so that the threads of the seam become covered. To remove the bulged strips thus formed over the seam, particularly if the leather is thick, the protruding edge portions of the leg parts are further removed to some extent, by means of a cutter-type tool. During this operation, too much of the material may inadvertently be removed and the seam may be damaged or even destroyed. Upon covering this seam, the leg parts are bent back into their position of use. During this operating step again, the leg parts may be bent nonuniformly, so that the seam comes to extend off the central line of the heel portion and spoils the outer appearance. This may happen particularly if the corresponding edge portions of the joined leg parts have initially been beveled and/or rolled back irregularly.

SUMMARY OF THE INVENTION

The invention is directed to a shoe in which the seam cannot be damaged during the further manufacturing operations, and an exact bending back of the leg parts, after they have been sewn together, is achieved.

In accordance with the invention the two parts to be joined together such as leather parts which are to form a shoe body are arranged in super imposition with their ends aligned. Each of the parts is aligned with a groove which is substantially parallel to the edge of the part and a thread seam is made to join the parts together which extends into the grooves. The parts are then formed into a configuration such as a heel body part of a shoe and in so doing the marginal area from the seam to the edge is bent back upon itself so that it engages into the groove on the interior of the part being formed.

By providing the seam within the groove, the threads come to extend below the flesh side surface of the side or leg parts, so that they are securely protected against damage during the further manufacturing operations. The grooves reduce the thickness of the material in the respective area of the leg parts, but the life of the parts is not shortened by this reduction and the bending back of the leg parts about these two groove areas is advantageously facilitated. If during the machining, for example, milling, of the two grooves, care is taken to make the groove width and the spacing of the grooves from the edge proper of the leg parts to be joined, equal to each other, it is ensured that the leg parts will be bent back uniformly relative to the seam and that the seam will extend exactly in the center line of the heel portion.

According to a development of the invention, the grooves may be spaced from the edges of the leg part by a distance which is smaller than the width of the grooves. This permits the rib-like edge portions which are formed between each groove and the edge of the leg part, to engage the respective groove as the leg part is bent back so that undesirable bulged strips are avoided without any removal of material and, in addition, the locking interengagement of the ribs with the grooves results in such strong a stability in shape of the heel zone that the hitherto usual affixing of an adhesive tape can be omitted.

The inventive provisions are not limited to heel seams, however, and they may be applied with the same advantage also to other seams where the same problem is involved, namely of sewing together and then bending back two workpieces placed on each other in mirror-image position.

Up to the present time, the shape of the heel portion of shoes has been determined in accordance with a variety of factors depending on the manufacturer's experience and taking into account requirements of anatomy and fashion, and frequently resulting in an irregular geometry of the arcuate shapes of the shoe.

Since in a heel portion manufactured in accordance with the invention, a uniform spacing from the edge of both the groove cut in the leg part material and the seam extending therein is of great importance for obtaining a completely satisfactory result, it is advantageous in view of an automation of the groove-cutting and sewing operation, to provide an arcuate configuration of the leg part edges and consequently, a shape of the groove and seam, based on simple geometry. To this end and in accordance with a development of the invention, it is provided that the shape of the leg parts in the heel portion is given by two or more circular arcs merging with each other, which can be defined in a simple way and, depending on the feed-control or guidance systems, can easily be programmed or, with the use of a device sensing the leg part edge, permit a simple analysis. Because of the lined-up circular arcs, the motion of the workpiece holders receiving the leg parts and of the cutting and sewing machines relative to each other, necessary during this cutting and sewing operations, can be simplified to the effect that either the workpiece holders or the cutting and sewing machines perform only circular motions with corresponding radii and arc lengths.

Since the parameters determining the shape of the heel portion, namely the number, radii, and lengths of the circular arcs, can be varied individually as well as in groups or all of them, an unlimited number of different heel shapes can be provided. Therefore, in practice, this inventive feature avoids any limitations to a free design of the heel portion. Also, experience has shown that by far the most known heel shapes can be defined by two circular arcs, anothers by three circular arcs, and a smaller number even by a single circular arc. A shape defined by a single circular arc is a special case of the geometry provided where the second circular arc has the length zero.

The heel shape design in accordance with the invention can generally be applied to any manufacture of heel portions, and is not limited to a manufacture where the leg parts are provided with a groove-like recess with the seam extending therein. The design of a heel portion with a contour formed of a plurality of merging circular arcs simplifies the workpiece guidance during the sewing of seams parallel to the edge, even if leg parts having only bevels instead of grooves are joined with each other.

Accordingly, it is an object of the invention to provide a method of joining two parts together particularly parts of a shoe body to form a heel which comprises aligning the two parts together with preferably their exterior surfaces abutting and either before this is done or after it is done forming grooves in the parts which are parallel to aligned edges of the parts, then interconnecting the parts with a seam extending through the parts located in the grooves, and folding the marginal area between the seam and the edge of associated parts such that it is bent back upon itself and a portion thereof falls into the groove.

A further object of the invention is to provide a shoe construction or a seam interconnection of two thick material parts particularly leather parts of shoes which comprises first and second parts to be joined together each having an end edge which is substantially aligned with the other end edge and having one surface with a recess defining a groove substantially parallel to and spaced inwardly of its associated edge, and including a threaded seam extending through and joining the parts together located in the respective grooves of said parts each of said parts having portions between the groove and the edge which are bendable upon itself and postionable in the groove.

A further object of the invention is to provide a shoe construction or a seam interconnection of parts which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
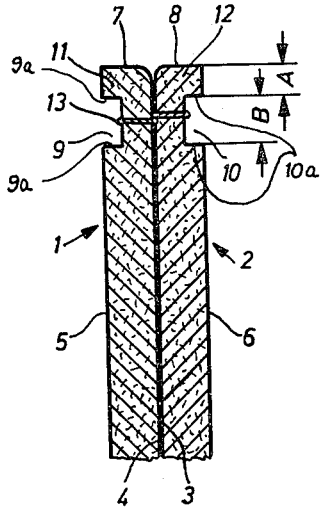
FIG. 1 is a partial sectional view indicating joining together of two parts to form a seam interconnection constructed in accordance with the invention.

Referring to the drawings in particular the invention embodied therein comprises a method and construction of a seam interconnection which as shown in FIG. 1 comprises the interconnection of two relatively thick parts such as leather shoe parts generally designated 1 and 2. Parts 1 and 2 have exterior surfaces such as the grain surface 3 and 4 respectively which are arranged in juxtaposition when the parts are in a flattened condition. The parts 1 and 2 also include interior or flesh surface side surfaces 5 and 6 which are provided with recesses 9 and 10 having side walls 9*a* and 10*a* which are made substantially parallel to end edges 7 and 8. The grooves 9 and 10 which are formed are advantageously made of a length B which is greater than the length of a remaining leg portion 11 and 12 between the groove and the edge 7 and 8.

In accordance with the method of the invention, the two parts after being aligned and having the grooves 9 and 10 formed either previously or after alignment are then joined together by a seam 13 which extends through the parts and is located within the respective grooves 9 and 10. The seam 13 which is formed of thread advantageously forms a thread area which is substantially parallel to the edges 7 and 8. After these two parts are joined together to form an interconnection the marginal end areas roughly between the stitch 13 and the edge 7 are bent back upon themselves, so that they extend into grooves 9 and 10, for example as shown in the construction of a heel part in a shoe generally designated 2 in FIG. 2. The two wall forming parts or leg parts 1 and 2 of an article such as a shoe shown in FIG. 1 are superposed in a flatened condition with their outer or exterior surfaces (leather grain sides) 3 and 4 interengaged while their insides 5 and 6, i.e. the flesh sides of the leather remain exposed. In the marginal area adjacent their aligned edges 7 and 8, each leg part 1 and 2 is provided on its inside surface 5 and 6 with respective grooves 9 and 10 extending parallel to the edge 7 and 8. The rib-like edge portion 11 and 12 is thereby formed between edges 7 and 8 and grooves 9 and 10. The distance A between edge 7 and 8 and groove 9 and 10, i.e. the width of the rib 11 and 12 is advantageously smaller than the width B of groove 9 and 10. Leg parts 1 and 2 are joined with each other by thread seam 13 extending parallel to the edge and within the grooves 9 and 10.

Figure 2:
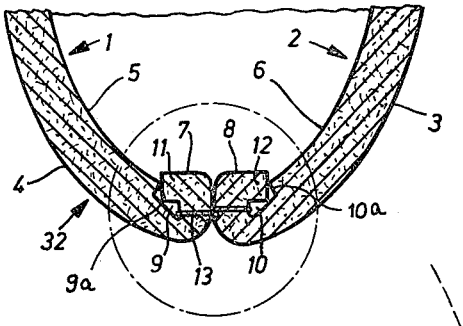
FIG. 2 is view similar to FIG. 1 indicating the parts employed in a shoe.

The leg part portions within the dash-dotted circle in FIG. 2 with the grooves 9 and 10, ribs 11 and 12 and the connecting seam 13 are shown in an embodiment in which they form the heel portion of a shoe generally designated 2.

In FIG. 2, leg parts 1 and 2 are shown in their bent-back position of use in which their outsides 3 and 4 extend on the outside of the shoe and their insides 5 and 6 on the inside of the shoe 2. Due to the bending of parts 1 and 2, ribs 11 and 12 engage in grooves 9 and 10, thereby covering the threads of connecting seam 13. Since in this position, ribs 11 and 12 bear against the opposite edge or side walls 9*a* and 10*a* of the respective grooves 9 and 10, the stability in the shape of the heel portion is increased. This at least partial engagement of ribs 11 and 12 in grooves 9 and 10 prevents the formation of undesirable bulges upon the bending of leg parts 1 and 2.

Since connecting seam 13 extends parallel to the edges, the configuration of the heel area of the shoe, after leg parts 1 and 2 have been bent back, remains identical with the configuration of edge 7 and 8 of the flatened leg parts 1 and 2 shown in FIG. 1.

Figure 3:
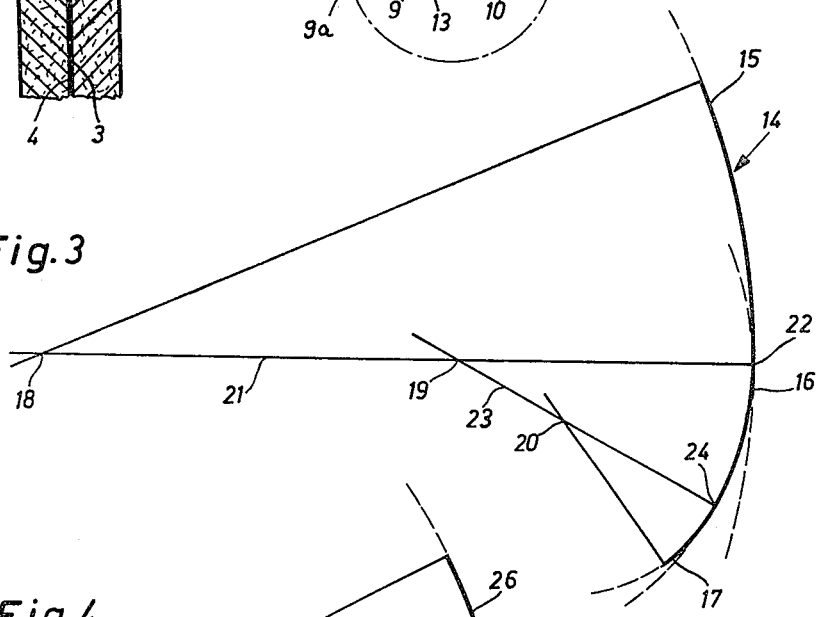
FIG. 3 indicates diagrammatically the formation of a shoe with a portion thereof formed of three circular arcs.
Figure 4:
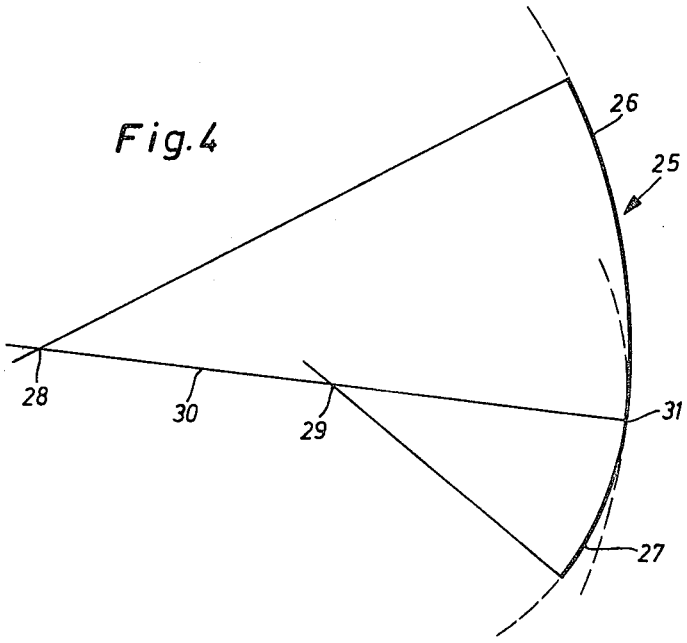
FIG. 4 is a view similar to FIG. 3 of a shoe heel portion formed of two circular arcs.

The arcuate lines 14 and 25 in FIGS. 3 and 4 show the shape of the side of a heel portion, or shape of the edge 7 or 8 of a leg part 1 and 2 shown in a side elevational view. The upper ends of arcuate lines 14 and 25 are in the zone of the leg opening of a shoe, while the lower ends are in the zone of the heel of a shoe.

Arcuate line 14 is composed of three circular arcs 15, 16 and 17 whose centers of curvature are indicated at 18, 19 and 20. Center 19 of circular arc 16 having a smaller radius than circular arc 15, is located on the radius 21 by which the final point 22 of circular arc 15 is determined. In the same way, the center 20 of circular arc 17 whose radius is smaller than than of circular arc 16 is located on radius 23 determining the final point 24 of circular arc 16. Due to this interrelation, the three circular arcs 15, 16 and 17 merge into each other continuously.

Identical relationship is provided for arcuate line 25 which is formed by two circular arcs 26 and 27 of which arc 27 has a smaller radius than arc 26. The centers of these circular arcs are indicated at 28 and 29 with center 29 of circular arc 27 being located on radius 30 by which the final point 31 of circular arc 26 is determined.

While specific embodiments of the invention have been shown and described in detail to illustrate the application of the principles of the invention, it will be understood that the invention may be embodied otherwise without departing from such principles.

What is claimed is:

1. A seam interconnection for material parts particularly leather parts of shoes, comprising first and second parts to be joined together each having an end edge which is substantially aligned with the end edge of the other part and having one surface with a recess defining a groove having side walls substantially parallel to and spaced inwardly of its associated end edge, a thread seam extending through and joining said first and second parts together extending within the respective grooves of said first and second parts and being parallel to said end edges, each of said parts having marginal areas between the associated groove and the end edge which are bent back upon themselves and engaged in the overlying groove and against a side wall thereof.

2. A seam interconnection according to claim 1 wherein said parts comprise a shoe leather part, said parts being formed into a curved heel configuration with each part being curved outwardly from the seam, said marginal edge parts between the respective groove and the adjacent end edge being bent back upon itself and extending into the associated groove of the respective part.

3. A seam interconnection according to claim 1 wherein said groove is spaced from the end edge of the associated part by a distance A which is smaller than the width B of said groove.

4. A seam interconnection according to claim 3 wherein each of said parts have a configuration which is formed of at least two circular arcs having different centers and different radii with the center of curvature of the circular arc having a smaller radius being located on a radius determining the final point of the adjoining circular arc of larger radius.

5. A shoe comprising a foot receiving shoe body, said body having a side portion on each side joined together to form a heel portion at one end and having an end edge and a rear edge marginal portion extending along the height of its rear edge which is bent back along itself, each side portion having a recessed groove underlying the back bent marginal edge portion at a location spaced inwardly from its rear edge with side walls which are parallel to a respective end edge, a thread seam joining said side portions together extending within the groove and parallel to the end edges, said side portions being curved outwardly from the seam to form the heel portion and said bent back portions being positioned in the groove of the associated part and locked against a respective side wall of the groove.

6. A shoe according to claim 5 wherein said groove is formed on an interior flesh surface side of the leather.

* * * * *